US009297105B2

(12) United States Patent
Mueller

(10) Patent No.: US 9,297,105 B2
(45) Date of Patent: Mar. 29, 2016

(54) CIRCUIT CONFIGURATION, HOUSEHOLD DEVICE AND METHOD FOR OPERATING THE HOUSEHOLD DEVICE

(71) Applicant: DIEHL AKO STIFTUNG & CO. KG, Wangen (DE)

(72) Inventor: Roland Mueller, Opfenbach (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 542 days.

(21) Appl. No.: 13/649,453

(22) Filed: Oct. 11, 2012

(65) Prior Publication Data

US 2013/0088098 A1 Apr. 11, 2013

(30) Foreign Application Priority Data

Oct. 11, 2011 (DE) ..... 10 2011 115 502
Aug. 21, 2012 (DE) ..... 10 2012 016 412

(51) Int. Cl.
*H02H 11/00* (2006.01)
*D06F 37/42* (2006.01)
*A47L 15/46* (2006.01)

(52) U.S. Cl.
CPC ..... *D06F 37/42* (2013.01); *A47L 15/46* (2013.01)

(58) Field of Classification Search
CPC ..... D06F 2224/00
USPC ..... 307/26; 68/12.26; 318/445
See application file for complete search history.

(56) References Cited

U.S. PATENT DOCUMENTS

| | | | | |
|---|---|---|---|---|
| 5,150,489 | A * | 9/1992 | Kaji et al. | 68/12.23 |
| 5,760,493 | A | 6/1998 | Outcalt et al. | |
| 2008/0202170 | A1 * | 8/2008 | Simon | 68/12.26 |
| 2010/0251776 | A1 | 10/2010 | Bischoff et al. | |

FOREIGN PATENT DOCUMENTS

| | | | |
|---|---|---|---|
| DE | 1916808 | A1 | 10/1970 |
| DE | 102007031882 | A1 | 4/2009 |
| EP | 0775463 | A2 | 5/1997 |
| WO | 2009007380 | A1 | 1/2009 |
| WO | 2009071413 | A1 | 6/2009 |

* cited by examiner

*Primary Examiner* — Jared Fureman
*Assistant Examiner* — Rafael Pacheco
(74) *Attorney, Agent, or Firm* — Laurence A. Greenberg; Werner H. Stemer; Ralph E. Locher

(57) ABSTRACT

A circuit configuration for operating a household device contains a power supply connector, an electrical load that is connected via a power connection cable to the power supply connector, and a controller for an endangering component. The controller is connected via a power connection cable to the power supply connector. A device for switching the controller on and off is arranged between the controller and the power supply connector. Safety equipment for disconnecting the controller from the power supply connector is arranged between the power supply connector and the device for switching. In order to supply the controller with electrical power even when the safety equipment is active, the electrical load is connected between the power supply connector and the safety equipment. A connecting cable is provided that connects the controller via the electrical load to the power supply connector, and in which the device for switching is arranged.

12 Claims, 2 Drawing Sheets

CIRCUIT CONFIGURATION, HOUSEHOLD DEVICE AND METHOD FOR OPERATING THE HOUSEHOLD DEVICE

CROSS-REFERENCE TO RELATED APPLICATION

This application claims the priority, under 35 U.S.C. §119, of German applications DE 10 2011 115 502.7, filed Oct. 11, 2011 and DE 10 2012 016 412.2, filed Aug. 21, 2012; the prior applications are herewith incorporated by reference in their entireties.

BACKGROUND OF THE INVENTION

Field of the Invention

The present invention concerns a circuit configuration, in particular for operating a household device with an endangering component, and a method for operating a household device with an endangering component.

FIG. 1 shows a conventional circuit configuration for operating a household device, using the example of a washing machine. A circuit configuration of this sort normally contains a mains connection 36, power connection cables 38 joined to the mains connection, various electrical loads such as a water pump 12*a*, an Aquastop valve 12*b* and a heater 12*c*. A safety device 15 with electronics monitors a locking of a door 15*a*, whereby only an input to the electronics is illustrated, and with a safety switch 14 and a motor controller 16 for a drive motor 30 of the washing machine drum.

For safety reasons regulations require that a drive motor 30 of a washing machine drum may not be operated when the loading door of the washing machine is not locked. The door locking monitor 15 here ensures that when the door is unlocked the motor controller 16, and thereby the drive motor 30 of the washing machine drum, are disconnected from the mains connection 36, in that the safety switch 14 is opened automatically. Accidental operation of the drive motor 30 of the washing machine drum, which represents a component that is endangering to the user, is thus not possible when the loading door of the washing machine is unlocked, and thus in particular when it is opened.

After the door has been locked, the safety switch 14 closes again automatically, so that the motor controller 16 can be connected via a relay 18 in the power connection cable 38. The motor controller 16 contains, in addition to a rectifier bridge 22 and intermediate circuit capacitor 24, also a current limiting resistor (e.g. an NTC or PTC resistor) 26, which limits the starting current. The current limiting resistor 26 is subsequently bridged by a relay 28 of the motor controller 16, in order to supply the drive motor 30 with the energy necessary for operation through the rectifier bridge 22.

While the motor controller 16 is disconnected from the mains connection 36 by the open safety switch 14, communication between the motor controller 16 and a main controller 34 of the washing machine over, for instance, a bus system is not possible, since the energy supply to the motor controller 16 is interrupted by the safety switch 14. This means that communication between the motor controller 16 and the main controller 34 of the washing machine is not possible until after the loading door has been locked. As a consequence of this, for instance, a loading sensor connected to the motor controller 16 can only be activated after the loading door has been locked. The result of this is that checking the extent to which the washing machine drum has been loaded is laborious for the user, since the loading door must first be locked before a loading value can be found. If the maximum load has not yet been reached, or if it has been exceeded, it may be necessary for the user to open and close the loading door a number of times in order to optimize the size of the load.

SUMMARY OF THE INVENTION

It is therefore the task of the present invention to disclose an improved circuit configuration and an improved method for operating a device that includes an endangering component.

The circuit configuration according to the invention contains a power supply connector, an electrical load that is connected via a power connection cable to the power supply connector, and a controller for an endangering component. The controller is connected via a power connection cable to the power supply connector. A device for switching the controller on and off is arranged between the controller and the power supply connector in the power connection cable. Safety equipment disconnects the controller from the power supply connector, which is arranged between the power supply connector and the device for switching in the power connection cable. In the circuit configuration according to the invention, the electrical load is connected between the power supply connector and the safety equipment, and a connecting cable is provided that connects the controller via the electrical load to the power supply connector, and in which a further device for switching is arranged.

In the method according to the invention for operating the device with the endangering component, an electrical load is connected through a power connection cable to a power supply connector. A controller for the endangering component can be connected through a power connection cable to the power supply connector. The controller can be disconnected from the power supply connector by the safety equipment arranged in the power connection cable. When the controller is disconnected from the power supply connector by the safety equipment, the controller is connected by a connecting cable through the electrical load to the power supply connector.

In accordance with the invention it is ensured that an endangering component (e.g. the drive motor of a washing machine drum) in an endangering condition (e.g. when the loading door of the washing machine is open) is not supplied with energy, and thus cannot start operation. For this purpose the controller of the endangering component in such an endangering condition is automatically disconnected from the power supply connector by the safety equipment in the power connection cable.

On the other hand, according to the invention, the controller of the endangering component continues to be supplied with energy even when the device is in such an endangering condition, although at a significantly lower energy level than is required to operate the endangering component. To this end, the controller of the endangering component is connected to the power supply connector with the aid of an additional connecting cable through an electrical load which is located in the circuit prior to the safety equipment. Because the controller is supplied with energy, it is able to exercise certain functionalities that require less energy even under an endangering condition in which operation of the endangering component is forbidden. In this way the controller can, under such an endangering condition, favorably continue to perform measurement tasks (e.g. of the level of loading of a washing machine drum), and can communicate with a main controller of the device.

Because, in the circuit configuration according to the invention, the controller of the endangering component is supplied with energy through an electrical load before it is switched on once the endangering condition has been eliminated, a current limiting resistor and its bypassing circuitry, as is required in conventional circuit configurations such as those of FIG. 1, can be omitted from the controller. In this way the structure of the controller can be simplified and the space required for the controller can be reduced. This is particularly advantageous when the controller is intended to be integrated into the endangering component (e.g. a motor controller integrated into the drive motor). In addition, due to its reduced weight, the controller is less sensitive to mechanical accelerations. This is again particularly advantageous when the controller is to be integrated into the endangering component.

The term "electrical load" refers in this connection to any kind of favorably high-resistance electrical load. The electrical resistance of the electrical load reduces the current supplied through the connecting cable to the controller of the endangering component to the extent that the energy is not sufficient for operation of the endangering component. On the other hand, the electrical resistance of the electrical load only reduces the current to an extent that sufficient energy is available to the controller of the endangering component for the execution of auxiliary functionalities. Favorably, the electrical load is an electrical load that is present in the device in any case. Depending on the type of device, pumps, heaters, valves and the like may favorably be considered for use as the electrical load. In addition to the electrical load by which the controller of the endangering component is connected through the connecting cable to the power supply connector, the circuit configuration can, of course, contain further electrical loads.

The term "endangering component" refers to a component of the device that can present a danger to the user of the device. This contains, for instance, moving or rotating components and their drives that are accessible to the user. Depending on the type of the device, the endangering component is the drum of a washing machine or dryer, a fan of an extractor hood and so forth, as well as their drives or drive motors.

In this context, the "safety equipment" may refer to any type of equipment that is appropriate for disconnecting the controller of the endangering component in response to a detected endangering situation. The safety equipment is favorably a device for switching that is arranged in the power connection cable between the controller and the power supply connector. The safety equipment is favorably coupled to a safety device or is integrated into one, configured to detect an endangering situation. Depending on the type of device, the safety device contains, for instance, electronics for monitoring the locking of the door which monitor the locked condition of a loading door of, for example, a washing machine, and that allow the safety equipment to open or close.

The "power connection cable" is an electrically conductive connection to the power supply connector. Favorably the power connection cable contains two conductors, each of which is connected to one pole or connector of the power supply connector. The electrical load and the controller can be connected to the power supply connector by the same power connection cable, or by other power connection cables.

In this context, the "device for switching" refers to any kind of component or element that can be switched between at least two switched conditions. Favorably the device for switching is configured to open or close an electrical connection or change between at least two electrical connection branches. Appropriate devices for switching include, in particular, relays, transistors and the like.

In a favorable embodiment of the invention, a switching function of the device for switching in the connecting cable is coupled to a switching function of the safety equipment in the power connection cable. In this way it is possible to arrange that the power supply to the controller is automatically switched on through the connecting cable when the power supply to the controller over the power connection cable is interrupted and/or that the power supply to the controller via the connecting cable is automatically interrupted again when the power supply to the controller via the power connection cable is established again.

Favorably, in the event that the disconnection of the controller from the power supply connector by the safety equipment is reversed, the controller is then again connected through the power connection cable to the power supply connector, so that the controller again has a low-resistance connection to the power supply connector and the endangering component can again be operated.

Favorably, the connection of the controller via the electrical load to the power supply connector is interrupted, in the event that the disconnection of the controller from the power supply connector is reversed by the safety equipment.

In a further favorable embodiment of the invention, the device for switching in the power connection cable and the device for switching in the connecting cable are integrated with one another or are implemented as a common device for switching. The common device for switching is favorably arranged in the power connection cable between the controller and the power supply connector, and can switch between the two electrical connection branches of the power connection cable and the connecting cable. In an alternative embodiment of the invention, in addition to the device for switching arranged in the power connection cable for switching the controller on and off, there is a further device for switching in the connecting cable between the controller and the electrical load.

In a further favorable embodiment of the invention, at least one diode is arranged in the connecting cable between the controller and the electrical load. The diode, which is connected in series with the electrical load when the controller is being supplied with power via the connecting cable, causes pulsating direct current to flow through the electrical load, so that in this condition of the circuit it cannot be activated unintentionally.

In a yet further favorable embodiment of the invention, the controller contains a rectifier bridge and an intermediate circuit capacitor connected in parallel therewith. This controller is particularly suitable for endangering components that have to be supplied with direct current, such as DC motors and, in particular, brushless DC motors. In this embodiment, the intermediate circuit capacitor is then charged from the power supply connector via the electrical load in the event that the controller is disconnected from the power supply connector by the safety equipment.

The subject matter of the invention is also a household device with a circuit configuration of the invention described above. In this context, the invention can favorably be applied to household devices such as washing machines, clothes dryers, dishwashers, stoves, ovens, extractor hoods, refrigerators, freezers and similar items.

Other features which are considered as characteristic for the invention are set forth in the appended claims.

Although the invention is illustrated and described herein as embodied in a circuit configuration, a household device and a method for operating the household device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The invention will now be described in more detail with the aid of a favorable example of an embodiment of a circuit configuration for operating a household device, taking a washing machine as the example. The same, or corresponding, components are here identified through the same reference numbers as in FIG. 1.

Figure 2:
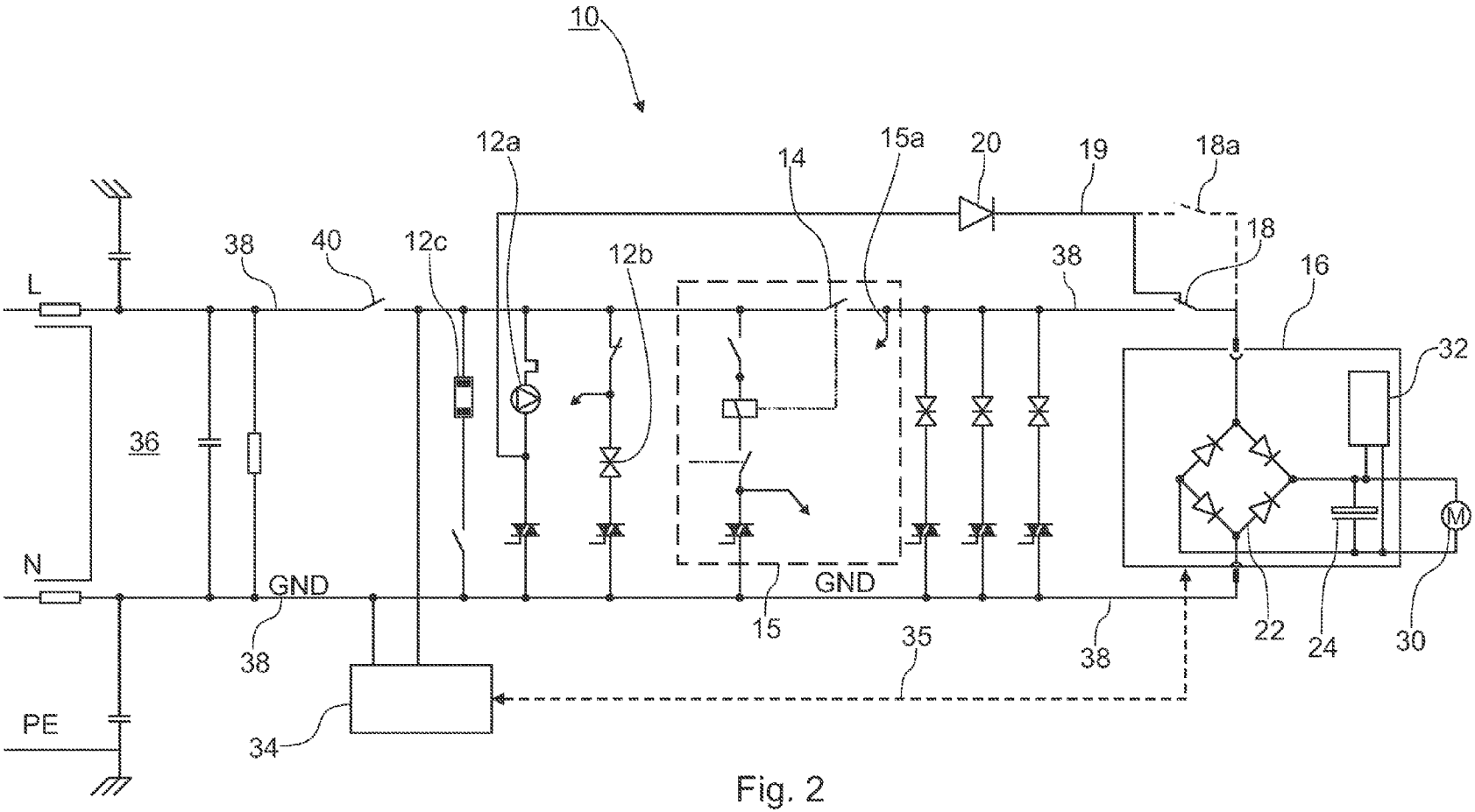
FIG. 2 is a block diagram of a circuit configuration for operating a household device according to one example of an embodiment according to the present invention.

The circuit configuration of FIG. 2 contains a power supply connector 36, with which it can be connected to a power supply network. The two conductors of a power connection cable 38 are connected to poles of the power supply connector 36. A main switch 40 for switching the household device and its components on and off is contained in one conductor of the power connection cable 38.

A variety of electrical loads such as a water pump 12*a*, an Aquastop valve 12*b* and a heater 12*c* are connected through the power connection cable 38 to the power supply connector 36.

The circuit configuration also contains a motor controller 16 for the operation of a drive motor 30 of the washing machine drum, which is an endangering component in the sense of the invention. The drive motor 30 is favorably a brushless DC motor. The motor controller 16 therefore contains a rectifier bridge 22 and an intermediate circuit capacitor 24.

The motor controller 16 is also connected through the power connection cable 38 to the power supply connector 36. A device for switching 18 in the form of a relay is here arranged in one connecting line of the power connection cable 38, in order to switch the motor controller on and off. The relay 18 can be arranged together with the motor controller 16 in a power module. The power module can, in turn, be integrated into the drive motor 30.

In addition to the motor controller 16, the household device also contains a main controller 34. This is also connected to the power connection cable 38. The main controller 34 is connected via a signal line 35, for instance in the form of a bus system, to the motor controller 16.

As is illustrated in FIG. 2, the motor controller 16 contains a device for sensing 32, which includes, for instance, a loading sensor that detects the level to which the washing machine drum has been loaded. The measurements yielded by the device for sensing 32 can be communicated via the signal line 35 to the main controller 34, which can evaluate them and, if appropriate, display them.

The power connection cable 38 also connects a safety device 15, having electronics to monitor a locking of a door 15*a*, to the power supply connector 36. For reasons of clarity, only the input to the electronics of the door locking monitor 15*a* is illustrated. The door locking monitor 15*a* monitors whether the loading door of the washing machine is locked. The safety device 15 also contains safety equipment in the form of a safety switch 14, arranged in one conductor of the power connection cable 38 between the device for switching 18 and the electrical loads 12*a-c*. If the door locking monitor 15*a* detects an endangering state in the form of an unlocked loading door of the washing machine, the door locking monitor 15*a* causes the safety switch 14 to be opened, interrupting the connection between the controller 16 via the power connection cable 38 and the power supply connector 36, so that the drive motor 30 can no longer be operated by the controller 16. The opening and closing of the safety switch 14 is triggered by the door locking monitor 15*a* by operating a solenoid in the door lock. If the loading door of the washing machine is closed, the safety switch 14 is closed automatically. The loading door is mechanically locked to prevent opening.

Figure 1:
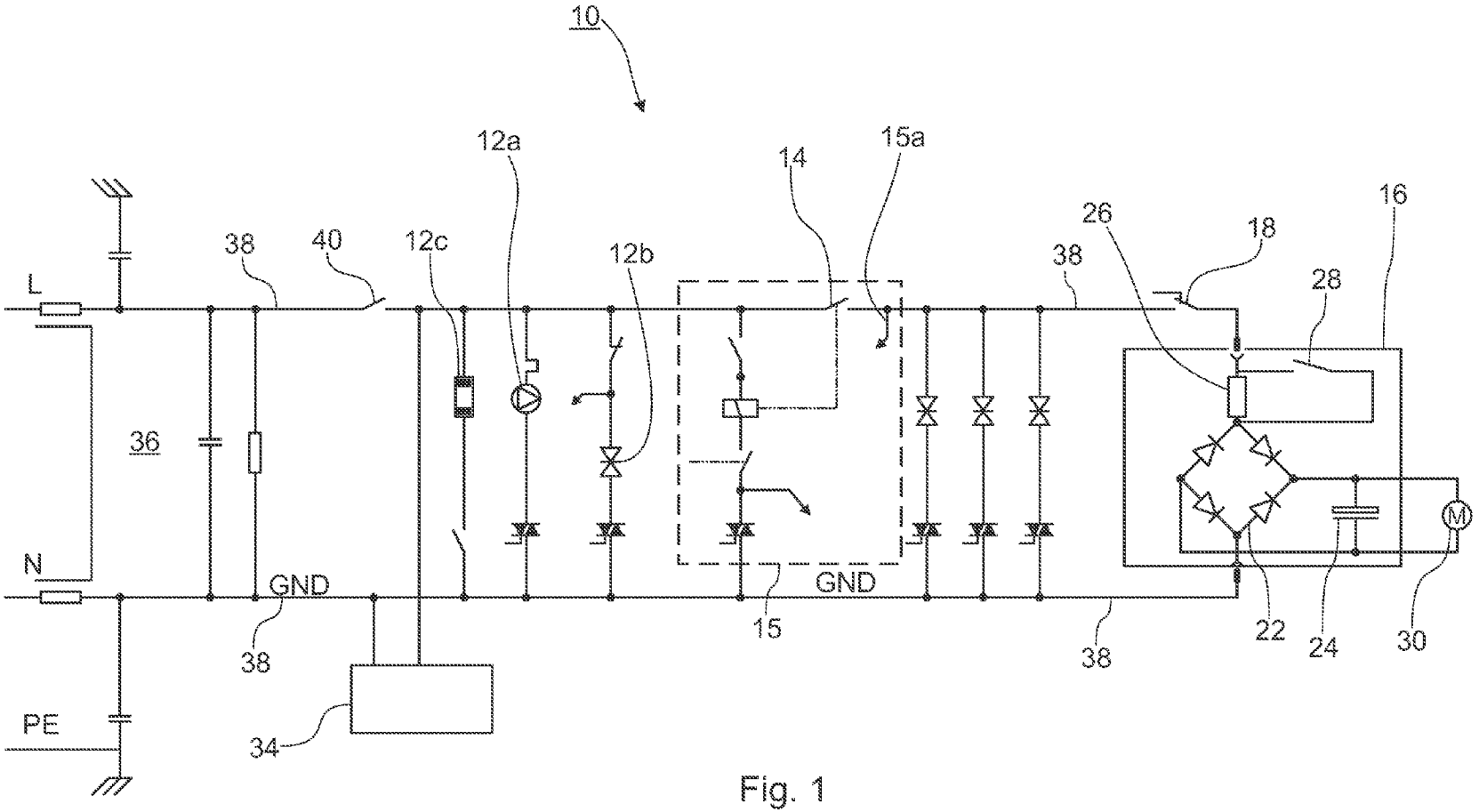
Fig. 1 PRIOR ART
FIG. 1 is a block diagram of a circuit configuration for operating a household device according to the prior art.

As is illustrated in FIG. 2, in comparison to the conventional circuit configuration of FIG. 1, a connecting cable 19 is additionally provided. The connecting cable 19 connects the motor controller 16, bypassing the safety device 15 and in particular the safety switch 14, via one of the electrical loads (in this case the pump 12*a*) to the power supply connector 36. Instead of the pump 12*a*, it is also possible for another electrical load (e.g. the Aquastop valve 12*b* or the heater 12*c*) to be connected to the connecting cable 19.

The electrical load 12*a* is arranged prior to the safety switch 14, i.e. between the safety switch 14 and the main switch 40; other electrical loads 12*b*, 12*c*, which are not connected to the connecting cable 19, can optionally also be arranged in the circuit after the safety switch 14. A device for switching is arranged in the connecting cable 19. The device for switching is either the relay 18 in the power connection cable 38 for switching the motor controller 16 on and off, which can switch between the power connection cable 38 and the connecting cable 19, or an additional relay 18*a* (the variant illustrated with dotted lines) in the connecting cable 19.

This circuit configuration functions as follows.

When the device is switched on (the main switch 40 is on) the door locking monitor 15*a* checks whether or not the loading door of the washing machine is closed and locked. If the loading door is locked, the door locking monitor 15 closes the safety switch 14 in the power connection cable 38. The motor controller 16 is thus connected via the power connection cable 38 to the power supply connector 36, and can be switched on by the relay 18 in the power connection cable 38. If the motor controller 16 is switched on by the relay 18, then it has a low-resistance connection to the power supply connector 36, and is supplied with sufficient energy from there to operate the device for sensing 32 and, in particular, also the drive motor 30 of the washing machine drum.

If the door locking monitor 15 now detects that the loading door is open, which signifies an endangering condition for the user, in which the washing machine drum must not turn and the drive motor 30 must not operate, then the safety switch 14 is opened, interrupting the electrical connection between the motor controller 16 and the power supply connector 36. This interruption occurs regardless of the circuit condition of the relay 18.

Because the motor controller 16 should be supplied with energy even in such an endangering state, in order to operate the device for sensing 32 and to communicate with the main controller 34, the relay 18 now switches over to the connecting cable 19 (or the relay 18 is opened and the relay 18*a* is closed). In this way, when the safety switch 14 is open, the motor controller 16 is connected via the connecting cable 19 and the electrical load 12*a* to the power supply connector 36.

Because of the electrical load 12*a* connected in series with motor controller 16, the connection has a high resistance. For this reason, the energy supplied to the motor controller 16 through the connecting cable 19 is insufficient to operate the drive motor 30. Nevertheless, the energy is sufficient to charge the intermediate circuit capacitor 24 and therefore to be able to operate the device for sensing 32 of the motor controller 16.

This means that in this circuit configuration, the motor controller 16 is still able to operate the device for sensing 32 even when the loading door is unlocked. It is thus possible, for instance, when the loading door of the washing machine is open, to detect the level of loading and to communicate this to the main controller 34. The level of loading detected can be displayed immediately to the user, so that he can load the washing machine drum optimally. In contrast to conventional circuit configurations, he does not have to open and close the loading door repeatedly for this purpose, but can complete his loading task immediately while the loading door is open.

As is illustrated in FIG. 2, a diode 20 is also connected in the connecting cable 19 in series with the electrical load 12*a*. Because of the diode 20, a pulsating direct current passes through the electrical load 12*a* during the charging of the intermediate circuit capacitor 24 through the connecting cable 19. This pulsating direct current prevents the electrical load 12*a* from being activated when the device is switched on. Disruptive pump noises can be avoided in this way.

If the loading door is then closed and locked by the user, the locked condition of the loading door is detected by the door locking monitor 15*a*, which then closes the safety switch 14 again by operating the solenoid in the door lock. At the same time, the relay 18 is also again switched over to the power connection cable 38 (or the relay 18*a* is opened and the relay 18 is closed), so that the pump 12*a* is switched parallel to the motor controller 16, and the motor controller 16, and therefore the drive motor 30, again have a low-resistance connection to the power supply connector 36. In this condition, unlocking the loading door can be detected at any time by the door locking monitor 15*a*.

Because when the loading door is unlocked the intermediate circuit capacitor 24 of the motor controller 16 is charged via the connecting cable 19 with a limited charging current due to the internal resistance of the electrical load 12*a*, a current limiting resistor and its bypassing relay of the conventional circuit configuration can be omitted from the motor controller 16.

LIST OF REFERENCE NUMBERS

10 Household device
12*a-c* Electrical load (pump, valve, heater etc.)
14 Safety equipment, safety switch
15 Safety device
15*a* Electronics to monitor the locking of the door
16 Controller for an endangering component, motor controller
18 Means of switching, relay
19 Connecting cable
20 Diode
22 Rectifier bridge
24 Intermediate circuit (capacitor)
26 Current limiting resistor
28 Relay
30 Motor, drive motor, DC motor
32 Means of sensing
34 Main controller
35 Signal line
36 Power supply connector, mains connection
38 Power connection cable
40 Main switch

The invention claimed is:

1. A circuit configuration, comprising:
a power supply connector;
a power connection cable;
an electrical load connected via said power connection cable to said power supply connector;
an endangering component;
a controller for said endangering component, said controller connected via said power connection cable to said power supply connector;
a device for switching said controller on and off, said device for switching disposed between said controller and said power supply connector in said power connection cable;
safety equipment for disconnecting said controller from said power supply connector, said safety equipment disposed between said power supply connector and said device for switching in said power connection cable;
said electrical load further connected between said power supply connector and said safety equipment; and
a connecting cable connecting said controller via said electrical load to said power supply connector, and within a path of said connecting cable said device for switching is disposed, said electric load limiting a current available to said controller such that the current is sufficient for maintaining an operational state of the controller, however the current being insufficient for driving said endangering component to an operational state.

2. The circuit configuration according to claim 1, wherein a switching function of said device for switching in said path of said connecting cable is coupled to a switching function of said safety equipment in a path of said power connection cable.

3. The circuit configuration according to claim 1, wherein said device for switching includes a first device for switching disposed in a path of power connection cable and a second device for switching disposed in said path of said connecting cable, said first and second devices for switching are integrated with one another.

4. The circuit configuration according to claim 1, further comprising a diode connected in said connecting cable.

5. The circuit configuration according to claim 1, wherein said controller has a rectifier bridge and an intermediate circuit capacitor connected in parallel with said rectifier bridge.

6. The circuit configuration according to claim 1, wherein the circuit configuration is provided for operating a household device.

7. A household device, comprising:
a circuit configuration, containing:
a power supply connector;
a power connection cable;
an electrical load connected via said power connection cable to said power supply connector;
an endangering component;
a controller for said endangering component, said controller connected via said power connection cable to said power supply connector;
a device for switching said controller on and off, said device for switching disposed between said controller and said power supply connector in said power connection cable;

safety equipment for disconnecting said controller from said power supply connector, said safety equipment disposed between said power supply connector and said device for switching in said power connection cable;

said electrical load further connected between said power supply connector and said safety equipment; and a connecting cable connecting said controller via said electrical load to said power supply connector, and within a path of said connecting cable said device for switching is disposed, said electric load limiting a current available to said controller such that the current is sufficient for maintaining an operational state of said controller, however the current being insufficient for driving the endangering component to an operational state.

8. A method for operating a device, which comprises the steps of:

connecting an electrical load through a power connection cable to a power supply connector;

connecting a controller for an endangering component through a power connection cable to the power supply connector;

disconnecting the controller from the power supply connector by means of safety equipment disposed in a path of the power connection cable; and connecting the controller by means of a connecting cable through the electrical load to the power supply connector when the controller is disconnected from the power supply connector by the safety equipment, the electric load limiting a current available to the controller such that the current is sufficient for maintaining an operational state of the controller, however the current being insufficient for driving the endangering component to an operational state.

9. The method according to claim 8, wherein when a disconnection of the controller from the power supply connector by the safety equipment is reversed, the controller is then again connected through the power connection cable to the power supply connector.

10. The method according to claim 9, which further comprises interrupting a connection of the controller through the electrical load to the power supply connector when the disconnection of the controller from the power supply connector is reversed by the safety equipment.

11. The method according to claim 8, wherein:

the controller contains an intermediate circuit capacitor; and the intermediate circuit capacitor, when the controller is disconnected from the power supply connector by the safety equipment, is then charged from the power supply connector through the electrical load.

12. The method according to claim 8, wherein the operating a device is a household device with an endangering component.

* * * * *